US006821096B2

(12) United States Patent
Kosmyna et al.

(10) Patent No.: US 6,821,096 B2
(45) Date of Patent: Nov. 23, 2004

(54) MULTIPLE COMPONENT METERING AND DISPENSING SYSTEM

(75) Inventors: Michael J. Kosmyna, Toledo, OH (US); Ralph Wisniewski, Toledo, OH (US)

(73) Assignee: Illinois Tool Works Inc., Glenview, IL (US)

( * ) Notice: Subject to any disclaimer, the term of this patent is extended or adjusted under 35 U.S.C. 154(b) by 33 days.

(21) Appl. No.: 10/232,454

(22) Filed: Aug. 30, 2002

(65) Prior Publication Data

US 2004/0040986 A1 Mar. 4, 2004

(51) Int. Cl.[7] ..... F04B 17/02

(52) U.S. Cl. ..... 417/399; 417/569; 417/403; 417/539; 417/527; 92/60.5; 222/145.5; 222/132

(58) Field of Search ..... 417/399, 338, 417/398, 569, 527, 401, 403, 539, 521; 92/60.5; 222/145.5, 132

(56) References Cited

U.S. PATENT DOCUMENTS 2,987,047 A * 6/1961 Young ..... 91/50
3,330,211 A * 7/1967 Faro et al. ..... 417/361
3,499,387 A * 3/1970 Zippel ..... 417/399
3,632,234 A * 1/1972 Lake ..... 417/390
4,043,710 A * 8/1977 Bunn et al. ..... 417/440
4,281,777 A * 8/1981 Akens ..... 222/134
4,752,192 A * 6/1988 Ode ..... 417/271
4,809,731 A * 3/1989 Walton et al. ..... 137/99
5,059,101 A * 10/1991 Valavaara ..... 417/569
5,275,539 A * 1/1994 Custer et al. ..... 417/401
5,361,943 A * 11/1994 Du ..... 222/134
5,582,350 A 12/1996 Kosmyna et al.
D386,654 S 11/1997 Kosmyna
5,725,125 A * 3/1998 Bessette et al. ..... 222/1
6,152,113 A * 11/2000 Yi ..... 123/499
6,270,323 B1 * 8/2001 Hsu ..... 417/399

OTHER PUBLICATIONS

Photograph of V.P. Rockey & Associates 2K Pump, 1 page.
ValueMix by Graco, Electronic Proportioner/Sprayer, Technical Specifications, 2 page.

* cited by examiner

*Primary Examiner*—Justine R. Yu
*Assistant Examiner*—Emmanuel Sayoc
(74) *Attorney, Agent, or Firm*—Barnes & Thornburg

(57) ABSTRACT

A plural component pumping apparatus including a piston and cylinder for each component to be pumped. Reciprocation of the piston in the cylinder draws the component into the cylinder during an intake stroke of the pumping apparatus and exhausts the material from the cylinder during an exhaust stroke of the pumping apparatus. Intake and exhaust valves are provided into the cylinder. Each of the intake and exhaust valve includes a housing oriented outside the cylinder to facilitate repair or replacement of the valves. A pumping motor on each side of the cylinder is coupled to a support and to the piston to move the support and piston relatively toward each other during the exhaust stroke and relatively away from each other during the intake stroke. A position indicator is coupled to the pumping motor. The pumping motor controls sense the position of the position indicator.

17 Claims, 8 Drawing Sheets

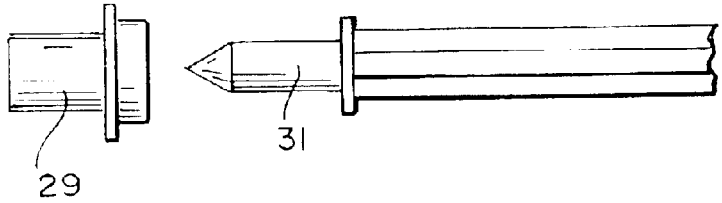
FIG. 3a
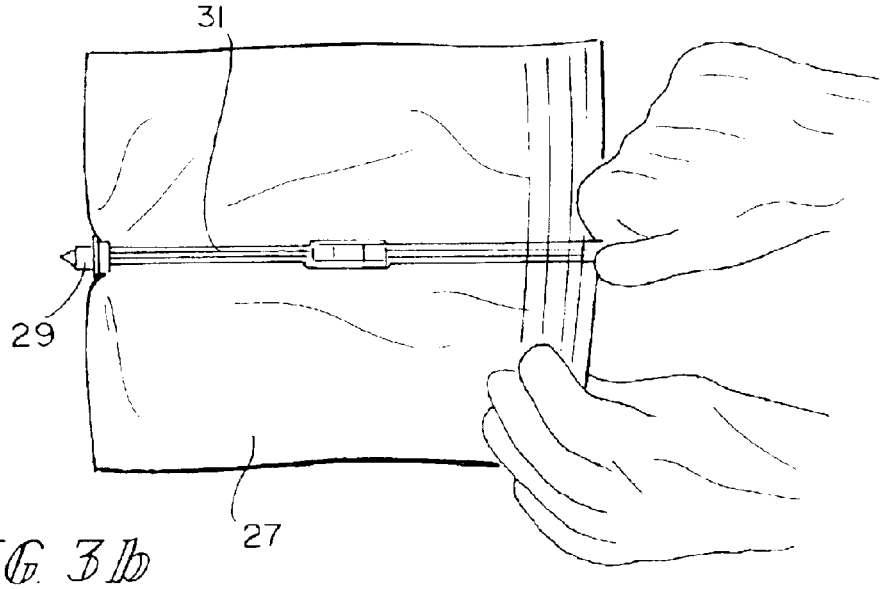
FIG. 3b
FIG. 3c
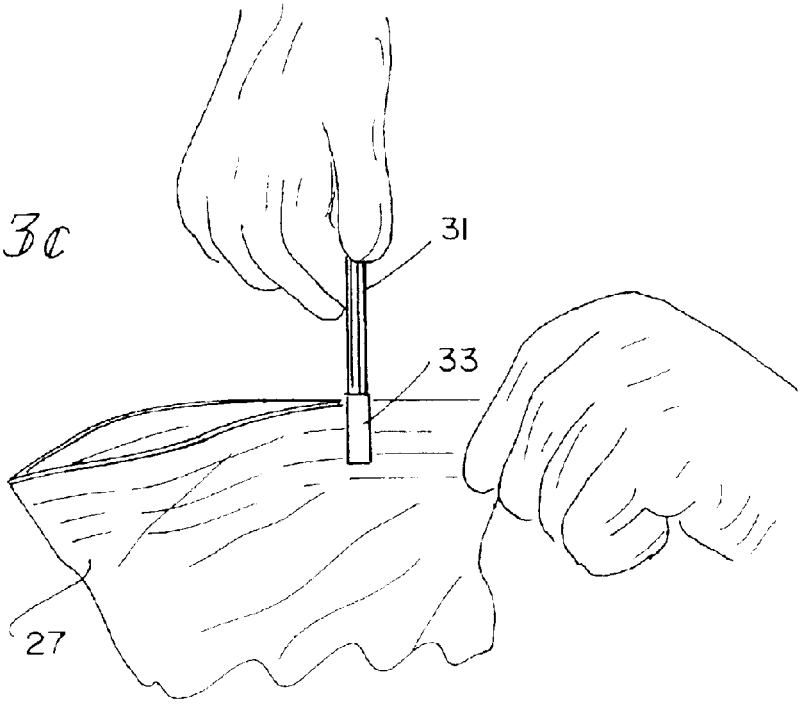

MULTIPLE COMPONENT METERING AND DISPENSING SYSTEM

FIELD OF THE INVENTION

This invention relates to dispensing systems for dispensing metered quantities of fluid components. It is disclosed in the context of dispensing systems for dispensing the components, for example, resin and catalyst, of a plural component system. However, it is believed to be useful in other applications as well.

BACKGROUND OF THE INVENTION

Many automotive refinishing and light industrial paints comprise multiple components. These are called plural component paints. Sometimes they are referred to as "n"K paints, that is, 2K for a two component paint, 3K for a three component paint, and so on. The components typically include, for example, a base component, such as, for example, a clear coat, an activator and a reducer.

These components are mixed in various ratios to obtain the final sprayable product. The ratios are typically measured and mixed by hand or by using expensive metering and pumping equipment. Once the activator is added, the sprayable pot life is short, for example, only one to three hours. Therefore, any excess mixed product becomes waste. The mixed product is expensive, for example, $40.00 U.S. per quart (about $42.00 U.S. per liter).

Painters using gravity- or suction-feed cup-type spray guns measure and mix the product by hand. Mixing too much, mixing the wrong ratio, and cleaning the gun generate waste. Painters using pressure-feed guns with remote paint tanks typically use expensive, for example, $5000–$15,000 U.S., metering and pumping equipment. This equipment pumps the metered and mixed product to the gun through, for example, 35 feet (about 11 meters) of hose. Since the product in the hose typically has only a one to three hour pot life, for example, it must be used or the hose must be flushed before the product hardens. Typical costs to flush a hose filled with mixed components in a 2K or 3K system are in the range of $0.50 U.S. per foot of hose (about $1.65 U.S. per meter of hose).

Many painters use pressure-feed guns to obtain large, that is, 10" to 12" (about 25 cm to about 30 cm or so), spray patterns. Newer gravity-feed cup-type guns can also spray that size pattern. In these devices, a reservoir, or cup, of the gun is filled with mixed 2K or 3K product from a metering system, and the mixed product is then dispensed from the gun. This eliminates much paint hose waste.

Ratio metering systems are typical of existing 2K and 3K dispensing equipment. The stroke of each pump in such equipment is adjustable to control the component ratios. Component pump mounting points are moved along a tilted plate, sometimes referred to as a rocker plate, to change the pumps' swept volumes, thereby adjusting the pumps' ratios. An air cylinder operates the pumps. There are also some systems that control the ratios electronically, such as, for example, the Ransburg E-Z Flow system.

DISCLOSURE OF THE INVENTION

According to one aspect of the invention, a dispensing system is provided for a material which is stored prior to dispensing in a container provided with a lid. A device for holding the lid on the container includes a flexible element. Ends of the flexible element are fixed to a component of the dispensing system. A threaded member is provided along the length of the flexible element. One end of the threaded member urges downwardly upon the lid. Threading of the threaded member in one direction forces the lid more tightly onto the container. Threading of the threaded member in another direction reduces the force with which the lid is held on the container.

Illustratively according to this aspect of invention, the threaded member is an eye screw.

Further illustratively according to this aspect of the invention, the lid includes a geometric center and the threaded member is threaded into a threaded opening provided therefor adjacent the geometric center. The flexible element includes a cable.

According to another aspect of the invention, a pumping apparatus includes a first piston and a first cylinder in which the first piston is reciprocable to draw material to be pumped into the first cylinder during an intake stroke of the pumping apparatus and to exhaust the material from the first cylinder during an exhaust stroke of the pumping apparatus. The first cylinderincludes a support. The apparatus further includes at least two pumping motors. The first cylinder is oriented between the pumping motors. The pumping motors are coupled to the support and to the first piston to move the support and first piston relatively toward each other during an exhaust stroke of the pumping apparatus and relatively away from each other during an intake stroke of the pumping apparatus.

Illustratively according to this aspect of the invention, the pumping motors each include a pumping motor piston and a pumping motor cylinder. The pumping motor pistons are coupled to the first piston.

Further illustratively according to this aspect of the invention, each pumping motor piston is coupled to a pumping motor connecting rod. The first piston is coupled to a first connecting rod. The pumping motor connecting rods and first connecting rod are coupled together.

Additionally illustratively according to this aspect of the invention, the pumping motor connecting rods and first connecting rod are coupled together by being coupled to coupling means.

Illustratively according to this aspect of the invention, the support includes means providing a first head for the first cylinder and a pumping motor head for each pumping motor.

Further illustratively according to this aspect of the invention, the support includes means providing an intake valve into the first cylinder, an exhaust valve from the first cylinder, and a port for supplying a driving fluid to each pumping motor.

Additionally illustratively according to this aspect of the invention, the support includes a first member at a first end of the first cylinder, a second member at a second end of the first cylinder, a base, and a side member supporting the second member from the base.

Illustratively according to this aspect of the invention, the pumping motors each include a pumping motor piston and a pumping motor cylinder including a cylinder head. The pumping motor pistons are coupled to the first piston. The base includes a stop for limiting movement of the pumping motor pistons away from their respective heads.

Further illustratively according to this aspect of the invention, the apparatus includes means coupled to the second member for guiding the pumping motor connecting rods.

Illustratively according to this aspect of the invention, the apparatus includes plural first pistons and plural first cylinders in which respective first pistons are reciprocable to draw plural materials to be pumped into respective first cylinders during an intake stroke of the pumping apparatus and to exhaust the plural materials from respective first cylinders during an exhaust stroke of the pumping apparatus.

Additionally illustratively according to this aspect of the invention, the first piston includes integral seal means.

Illustratively according to this aspect of the invention, the first connecting rod includes means for adjusting the stroke of the first connecting rod to adjust the output of the pumping apparatus.

Further illustratively according to this aspect of the invention, the means for adjusting the stroke of the first connecting rod includes means selectively movable along the length of the first connecting rod. The coupling means engages the means selectively movable along the length of the first connecting rod to move the first piston.

Additionally illustratively according to this aspect of the invention, the apparatus includes a gauge to assist in adjusting the stroke of the first connecting rod.

Illustratively according to this aspect of the invention, the apparatus includes position indicating means provided on the coupling means, and pumping motor control means for sensing the position of the position indicating means.

Further illustratively according to this aspect of the invention, the apparatus includes lubricating means provided on the first piston for lubricating the first cylinder.

Additionally illustratively according to this aspect of the invention, the lubricating means includes a disk of a material impregnated with a lubricant.

According to another aspect of the invention, a pumping apparatus includes a first piston, a first cylinder in which the first piston is reciprocable to draw material to be pumped into the first cylinder during an intake stroke of the pumping apparatus and to exhaust the material from the first cylinder during an exhaust stroke of the pumping apparatus. The first cylinder includes a support. The apparatus further includes a pumping motor coupled to the support and to the first piston to move the support and first piston relatively toward each other during an exhaust stroke of the pumping apparatus and relatively away from each other during an intake stroke of the pumping apparatus. The apparatus further includes position indicating means coupled to the pumping motor, and means for sensing the position of the position indicating means.

Illustratively according to this aspect of the invention, the pumping motor includes a pumping motor piston and a pumping motor cylinder. The pumping motor piston is coupled to the first piston.

Further illustratively according to this aspect of the invention, the pumping motor piston is coupled to a pumping motor connecting rod, the first piston is coupled to a first connecting rod, and the pumping motor connecting rod and first connecting rod are coupled together.

Additionally illustratively according to this aspect of the invention, the pumping motor connecting rod and first connecting rod are coupled together by being coupled to coupling means.

Illustratively according to this aspect of the invention, the position indicating means is provided on the coupling means.

Further illustratively according to this aspect of the invention, the support includes means providing a first head for the first cylinder and a pumping motor head for the pumping motor.

Additionally illustratively according to this aspect of the invention, the support further includes means providing an intake valve into the first cylinder and an exhaust valve from the first cylinder and a port for supplying a driving fluid to the pumping motor.

Illustratively according to this aspect of the invention, the means for sensing the position of the position indicating means includes pumping motor control means for reversing the pumping motor when the means for sensing the position of the position indicating means senses that the pumping motor has reached a limit of its travel.

Further illustratively according to this aspect of the invention, the means for sensing the position of the position indicating means includes means for sensing a limit of travel of the pumping motor in a first direction to exhaust material from the first cylinder, and means for sensing a limit of travel of the pumping motor in a second direction to take material into the first cylinder. The control means further includes an on/off switch oriented in the control means to prevent deactivation of the apparatus when the sensing means senses the limit of travel of the pumping motor in the first direction.

According to yet another aspect of the invention, a pumping apparatus includes a first piston and a first cylinder in which the first piston is reciprocable to draw material to be pumped into the first cylinder during an intake stroke of the pumping apparatus and to exhaust the material from the first cylinder during an exhaust stroke of the pumping apparatus. The apparatus further includes an intake valve into the first cylinder and an exhaust valve from the first cylinder. Each of the intake and exhaust valve is oriented outside the first cylinder.

Illustratively according to this aspect of the invention, each valve includes a first portion for coupling to the first cylinder and a second portion for coupling the intake valve to a component source and the exhaust valve to a device for utilizing the pumped material.

Further illustratively according to this aspect of the invention, the first cylinder includes an exhaust port provided with a seat. The exhaust valve includes a valve closure member and means for yieldably urging the valve closure member into sealing engagement with the seat during the intake stroke of the pumping apparatus.

Additionally illustratively according to this aspect of the invention, the first cylinder includes an intake port. The intake valve includes a housing coupled to the intake port. The housing includes a seat, valve closure member, and means for yieldably urging the valve closure member into sealing engagement with the seat during the exhaust stroke of the pumping apparatus.

Additionally illustratively according to this aspect of the invention, each of the intake and exhaust valves further includes a component for inserting into the housing. The valve closure member, yieldable urging means and component are placed in the housing in a first orientation in the intake valve, and in a second orientation in the exhaust valve.

According to yet another aspect of the invention, a method for dispensing a desired ratio of two fluids includes providing a first piston and first cylinder, and a second piston and second cylinder. The first piston is reciprocated in the first cylinder to exhaust a first amount of the first fluid from the first cylinder during an exhaust stroke of the first piston in the first cylinder. The second piston is reciprocated in the second cylinder to exhaust a second amount of the second fluid from the second cylinder during an exhaust stroke of the second piston in the second cylinder. The first and second amounts are collected in a common container.

Further illustratively according to this aspect of the invention, the method includes adjusting at least one of the stroke of the first piston in the first cylinder and the stroke of the second piston in the second cylinder to adjust the ratio.

Illustratively according to this aspect of the invention, adjusting at least one of the stroke of the first piston in the first cylinder and the stroke of the second piston in the second cylinder to adjust the ratio includes providing a gauge for determining the stroke of the first piston in the first cylinder and the stroke of the second piston in the second cylinder.

Additionally illustratively according to this aspect of the invention, the method includes providing a third piston and a third cylinder, reciprocating the third piston in the third cylinder to exhaust a third amount of a third fluid from the third cylinder during an exhaust stroke of the third piston in the third cylinder, and collecting the third amount with the first and second amounts in the common container.

Further illustratively according to this aspect of the invention, the method includes adjusting at least one of the stroke of the first piston in the first cylinder, the stroke of the second piston in the second cylinder and the stroke of the third piston in the third cylinder to adjust the ratio.

Illustratively according to this aspect of the invention, adjusting at least one of the stroke of the first piston in the first cylinder, the stroke of the second piston in the second cylinder and the stroke of the third piston in the third cylinder to adjust the ratio includes providing a gauge for determining the stroke of the first piston in the first cylinder, the stroke of the second piston in the second cylinder and the stroke of the third piston in the third cylinder.

Illustratively according to this aspect of the invention, collecting the first, second and third amounts in a common container comprises collecting the first, second and third amounts in a paint cup of a gravity-, suction- or pressure-feed dispenser.

According to another aspect of the invention, a pumping apparatus includes a first piston and a first cylinder in which the first piston is reciprocable to draw a first material to be pumped into the first cylinder during an intake stroke of the first piston in the first cylinder and to exhaust the first material from the first cylinder during an exhaust stroke of the first piston in the first cylinder. The apparatus further includes a second piston and a second cylinder in which the second piston is reciprocable to draw a second material to be pumped into the second cylinder during an intake stroke of the second piston in the second cylinder and to exhaust the second material from the second cylinder during an exhaust stroke of the second piston in the second cylinder. The apparatus further includes means for adjusting the length of the stroke of the first piston in the first cylinder relative to the length of the stroke of the second piston in the second cylinder to adjust the ratio of the volumes of the first and second materials pumped during the respective strokes of the first and second pistons in their respective first and second cylinders. The adjusting means includes means for locking at least one of the first piston at a maximum stroke in the first cylinder and the second piston at a maximum stroke in the second cylinder in order to enhance priming of the at least one of the first and second cylinders.

Illustratively according to this aspect of the invention, the means for locking at least one of the first piston at a maximum stroke in the first cylinder and the second piston at a maximum stroke in the second cylinder includes means for locking both the first piston at a maximum stroke in the first cylinder and the second piston at a maximum stroke in the second cylinder in order to enhance priming of both the first and second cylinders.

According to yet another aspect of the invention, a pumping apparatus includes a first piston and a first cylinder. The first piston is reciprocable in the first cylinder to draw material to be pumped into the first cylinder during an intake stroke of the pumping apparatus and to exhaust the material from the first cylinder during an exhaust stroke of the pumping apparatus. The apparatus further includes a pumping motor piston and a pumping motor cylinder. The pumping motor piston is coupled to the first piston to control movement of the first piston in the first cylinder. Pumping fluid from a pumping fluid source causes reciprocation of the pumping motor piston in the pumping motor cylinder to pump the material. At least a first intake port is provided into the pumping motor cylinder for the pumping fluid. At least a first exhaust port is provided from the pumping motor cylinder for the pumping fluid. A valve is provided for controlling at least one of the flow of the pumping fluid into the at least one intake port and the flow of the pumping fluid from the at least one exhaust port. The valve is adjustable to adjust at least one of the rate at which pumping fluid flows into the intake port and the rate at which pumping fluid flows from the exhaust port.

BRIEF DESCRIPTION OF THE DRAWINGS

The invention may best be understood by referring to the following detailed description and accompanying drawings which illustrate the invention. In the drawings:

FIGS. 3*a–c* illustrate steps in the preparation of a component to be dispensed by the dispensing system illustrated in FIG. 1;

DETAILED DESCRIPTION OF ILLUSTRATIVE EMBODIMENTS

In the following descriptions, words such as "top," "bottom," "Up," "down," and the like, are used with reference to the drawings only, and do not imply any limitations on the orientations of the various elements of the invention, nor should any such limitations be inferred.

Figure 1:
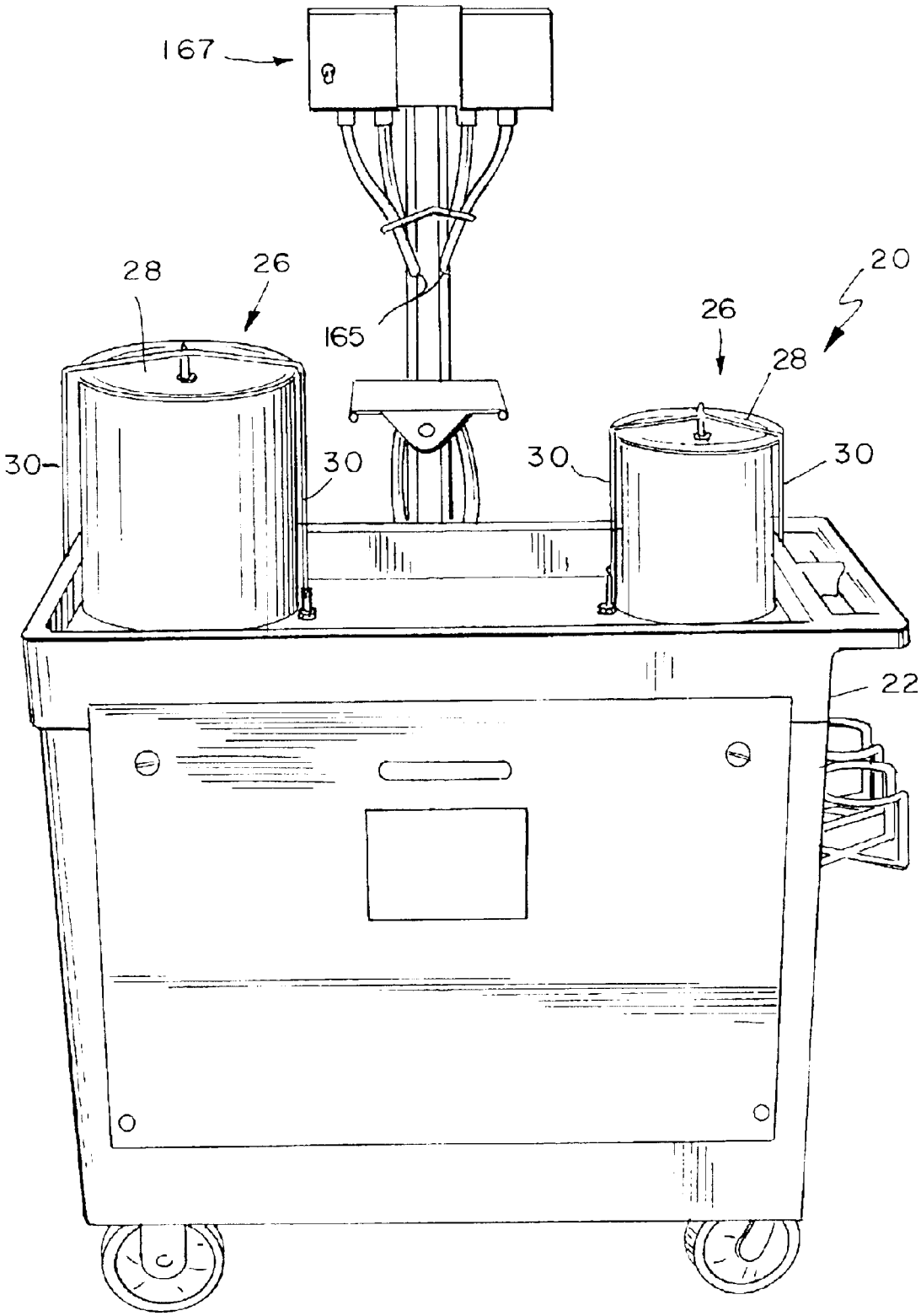
FIG. 1 illustrates a front perspective view of a plural component dispensing system constructed according to the invention.
Figure 2B:
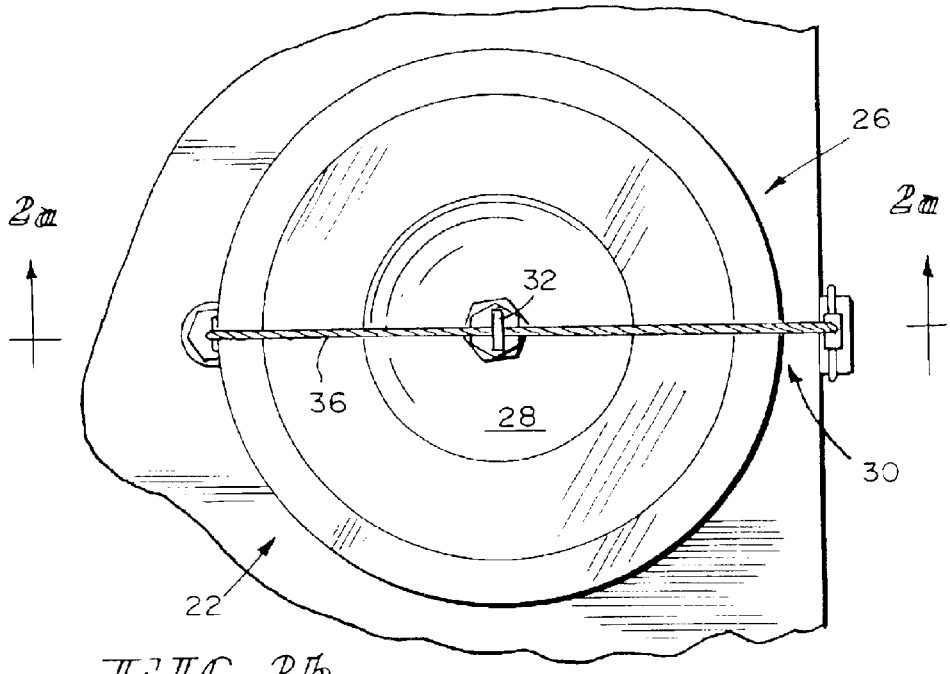
FIGS. 2*a–b* illustrate a partial sectional elevational view and a top plan view, respectively, of certain details of the system illustrated in FIG. 1, with FIG. 2*a* being a view taken generally along section lines 2*a*–2*a* of FIG. 2*b;*
Figure 2A:
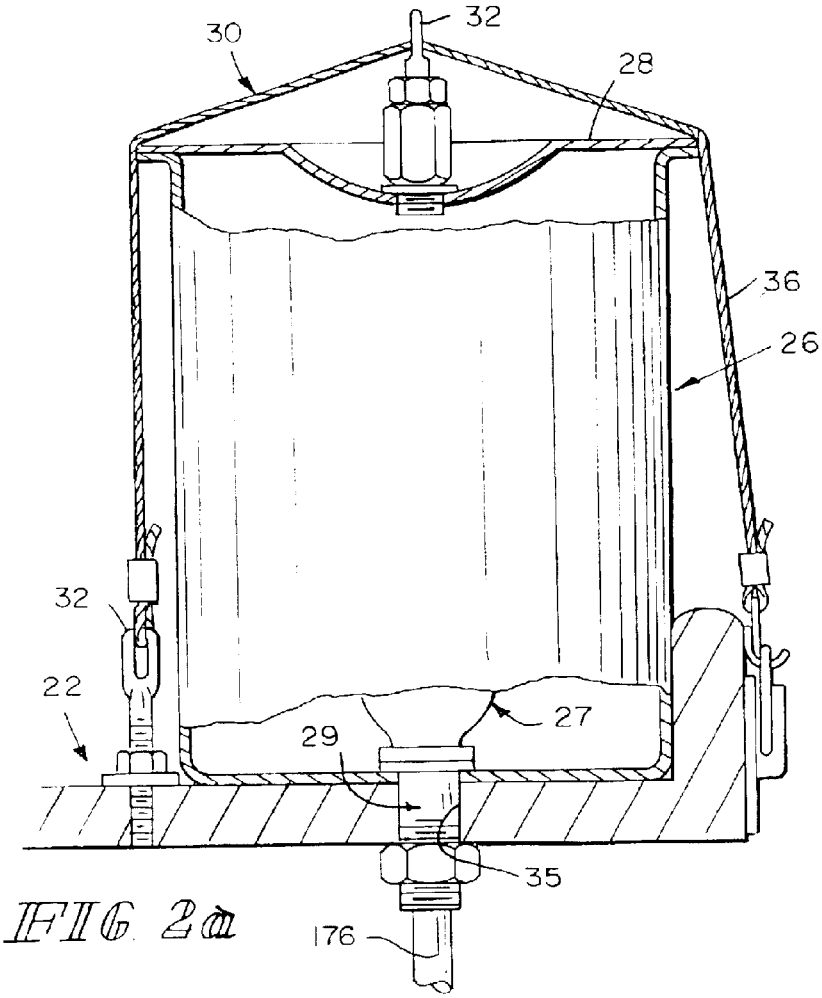

Turning now to FIGS. 1 and 2*a–b*, a plural component dispensing system 20 constructed according to the present invention includes a cabinet 22 housing a component pumping apparatus 24, FIGS. 4–8. Containers, or pots, 26 for, for example, a polymerizable clear or pigmented resin, an activator for promoting polymerization of the base component, and any other components of the material to be dispensed, are oriented on top of the cabinet 22. Pots 26 are provided with lids 28 which are held down by cable hold-downs 30 provided on the top of cabinet 22.

Referring to FIGS. 2*a–b* and 3*a–c*, the components to be dispensed are put into pots 26. The components may be put directly into the pots 26. However, in the illustrated system, to facilitate cleanup, the components are put into sealable disposable resin or polymer bags 27 with self-sealing feed tube connectors 29 provided in their bottoms, for example, using an insertion tool 31. The bags and insertion tool illustratively are of the general types illustrated and described in U.S. Pat. No. 5,582,350 and D 386,654. The bags 27 are filled with the components to be mixed by apparatus 24, sealed 33, and placed in the respective pots 26 with their connectors 29 protruding through openings 35 provided therefor in the top of the cabinet 22. The lids 28 are then placed on the pots 26, and cable hold-downs 30 are adjusted by turning eye screws 32 into or out of threaded openings provided for eye screws 32 at approximately the locations of the centers of the pot lids 28. The cables 36 of hold-downs 30 are then threaded through the eyes of eye screws 32, and the cable 36 ends are attached to the top of cabinet 22, for example, by hooks provided on the top of the cabinet and loops provided in the ends of each cable 36, by loops provided in the ends of each cable 36 and eye screws 32 or the like provided in the top of cabinet 22, or the like. The illustrated system thus employs single latch pot covers. This simplifies cover removal and installation. Typical prior art component covers are held in place by multiple, for example, four, clamps, or are twist-on type covers. The illustrated cable, latch and screw provide for easy removal and adjustment.

According to the invention, a multiple component metering and dispensing system dispenses the proper ratio of components, in the amount needed, directly into a paint cup of, for example, a suction-, pressure- or gravity-feed gun (not shown). Using a device such as a DeVilbiss Solvent Saver™ model hose and gun cleaner, model HD-503, to flush the system, the system minimizes solvent waste. The system substantially reduces measuring time, measuring mistakes, mixing time, cleanup time, and waste.

Figure 4:
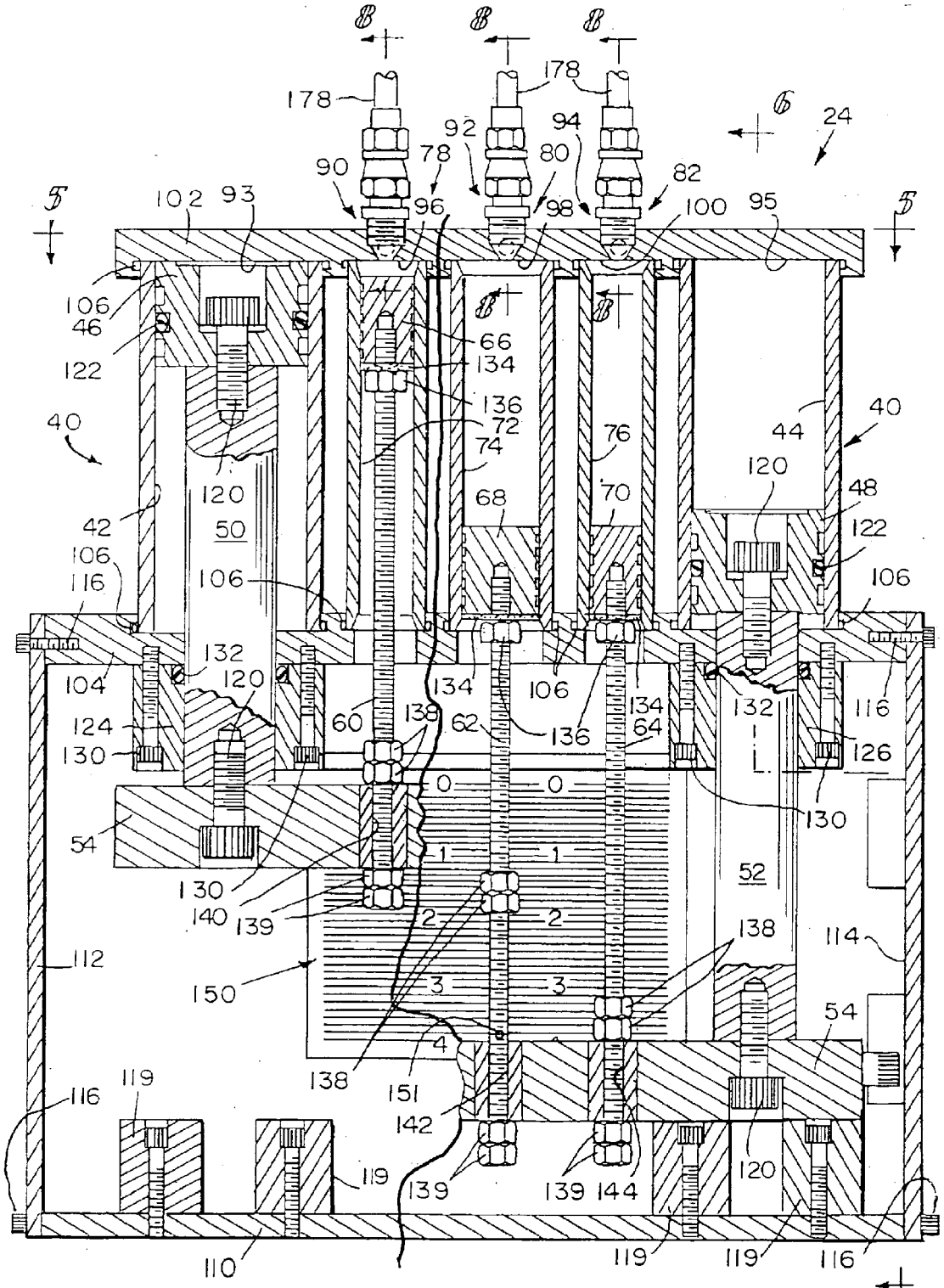
FIG. 4 illustrates a partly fragmentary, partly vertical sectional elevational view of certain details of the system illustrated in FIG. 1.
Figure 5:
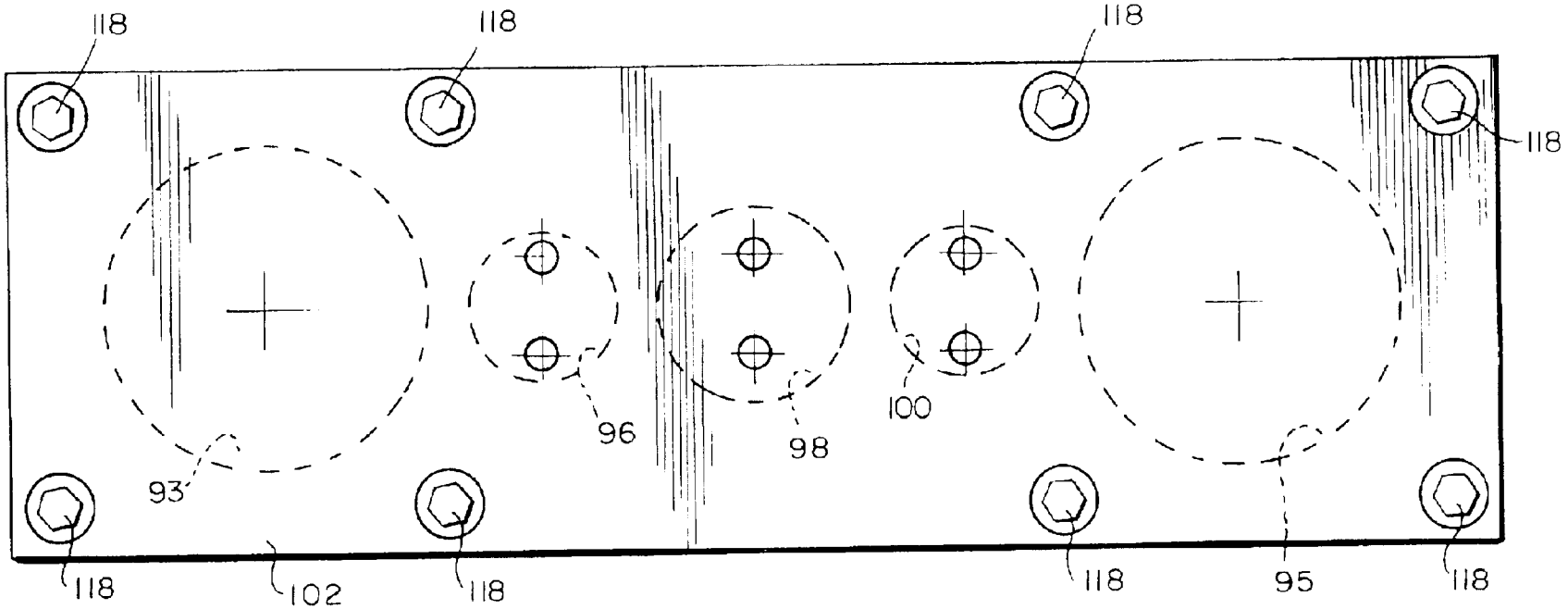
FIG. 5 illustrates a top plan view of certain details of the system illustrated in FIGS. 1 and 4, taken generally along section lines 5—5 of FIG. 4.
Figure 6:
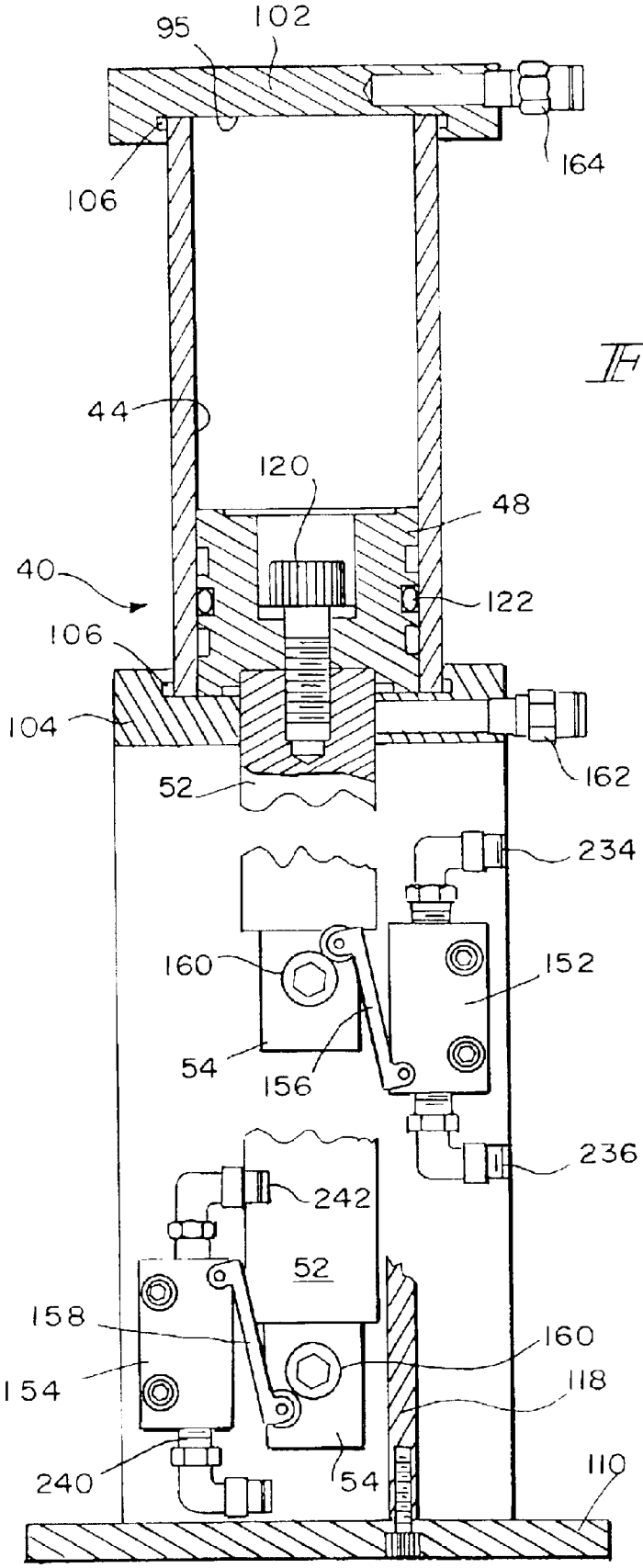
FIG. 6 illustrates a fragmentary sectional elevational view of certain details of the system illustrated in FIGS. 1, 4 and 5, taken generally along section lines 6—6 of FIG. 4.
Figure 7:
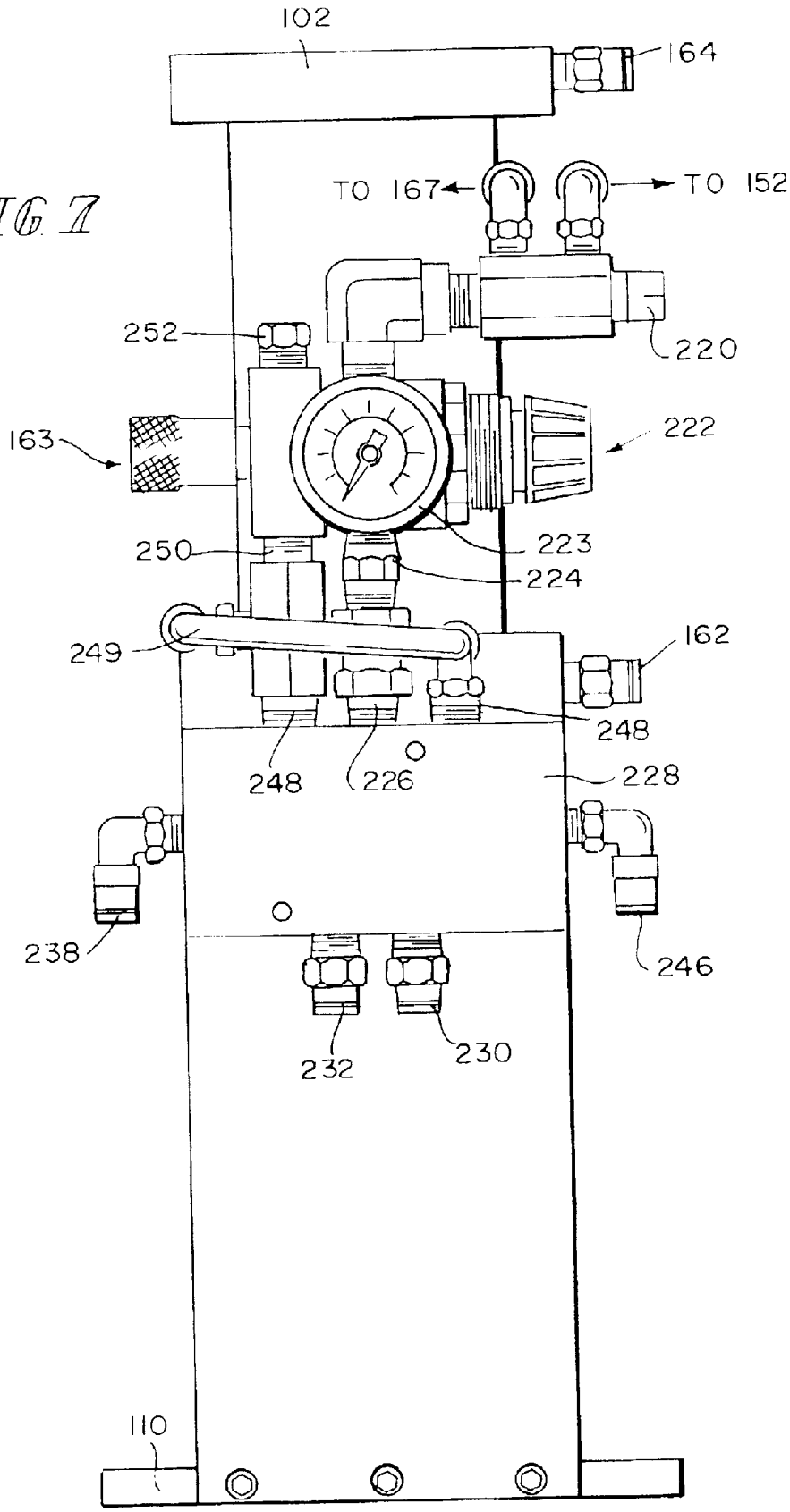
FIG. 7 illustrates a fragmentary elevational view of certain details of the system illustrated in FIGS. 1 and 4–6; and, FIG. 8 illustrates a much enlarged fragmentary sectional elevational view of certain details of the system illustrated in FIGS. 1 and 4–7, taken generally along section lines 8—8 of FIG. 4.

Referring now to FIGS. 4 and 6, the component pumping apparatus 24 includes an air motor 40 at each of its ends. Each air motor 40 includes a cylinder 42, 44 in which a piston 46, 48, respectively, is reciprocable. A connecting rod 50, 52, respectively, is provided on each piston 46, 48. The rods 50, 52 are connected to a push plate 54 which transfers the motion of pistons 46, 48 through piston rods 60, 62, 64 to respective pistons 66, 68, 70 which are reciprocable in respective cylinders 72, 74, 76. It should be noted that push plate 54 is illustrated in its uppermost orientation on the left side of FIG. 4, and in its lowermost orientation on the right side of FIG. 4. Push plate 54 is also illustrated in both its uppermost orientation and its lowermost orientation in FIG. 6. This is done for purposes of illustration of the two extreme positions taken by the air motors 40, pistons 66, 68, 70, and push plate 54.

Pistons 66, 68, 70 and cylinders 72, 74, 76 comprise the respective pumps 78, 80, 82 for the various components. Intake 84, 86, 88, and exhaust 90, 92, 94 check valves in the head 96, 98, 100 of each component pump 78, 80, 82, respectively, control the drawing of a respective component into the respective pump 78, 80, 82 on the intake stroke of the respective piston 66, 68, 70 through its respective intake valve 84, 86, 88 as the piston 66, 68, 70 is moved away from the head 96, 98, 100 of its respective cylinder, and pumping of the respective component from the swept volume of the respective cylinder 72, 74, 76 through its respective exhaust valve 90, 92, 94 on the exhaust stroke as the respective piston 66, 68, 70 is moved toward its respective head 96, 98, 100.

The cylinders 42, 44, 72, 74, 76 are supported between a top plate 102 which provides the heads 93, 95, 96, 98, 100 of cylinders 42, 44, 72, 74, 76, and a bottom plate 104. The cylinders 42, 44, 72, 74, 76 are appropriately sealed into both the top plate 102 and bottom plate 104 by O-ring seals 106 which are relatively inert to the materials which pass through the respective cylinders 42, 44, 72, 74, 76. The bottom plate 104 is in turn supported above a base plate 110 by side plates 112, 114 which are connected by cap screws 116 to both bottom plate 104 and base plate 110. Tie bolts 118, illustrated in FIGS. 5 and 6, hold top plate 102, bottom plate 104 and the cylinders 42, 44, 72, 74, 76 in assembled configuration. Base plate 110 includes bumpers 119 against which push plate 54 is stopped.

Pistons 46, 48 are connected to connecting rods 50, 52, and connecting rods 50, 52 to push plate 54 by cap screws 120. Appropriate seals, such as O-ring seals 122, are provided on pistons 46, 48. Connecting rods 50, 52 extend through rod-50-, -52-guiding bushings 124, 126, respectively. Bushings 124, 126 are connected to the underside of bottom plate 104 by cap screws 130. Appropriate seals, such as O-ring seals 132, are provided in bushings 124, 126 around connecting rods 50, 52.

Pistons 66, 68, 70 illustratively are one-piece piston/seal/wiper pistons, reducing parts count and simplifying assembly. The connecting rods 60, 62, 64 for each of pistons 66, 68, 70 are threaded, illustratively, although not necessarily, along their entire lengths. The connecting rods 60, 62, 64 are threaded into threaded openings provided in the pistons 66, 68, 70. Lubricating disks/washers 134 are then placed over each connecting rod 60, 62, 64 against the bottom of its respective piston 66, 68, 70 and captured by nuts 136 which are then threaded onto the connecting rods 60, 62, 64. The disk of a material 134, such as, for example, felt, is impregnated with lubricant. This reduces the need for periodic lubrication and prolongs seal life by reducing the likelihood that any of the components that leak past pistons 66, 68, 70 will dry inside cylinders 72, 74, 76 and compromise the piston 66's, 68's, 70's seals. Operators of prior art systems are cautioned to lubricate the pumps' cylinders or rods.

The connecting rods 60, 62, 64 are connected to push plate 54 by threading a pair of locknuts 138 on each respective connecting rod 60, 62, 64, inserting the connecting rods 60, 62, 64 through passageways 140, 142, 144 provided therefor in push plate 54, and threading another pair of locknuts 139 on each respective connecting rod 60, 62, 64. The threaded connecting rods 60, 62, 64 and locknuts 138 permit the stroke of each respective piston 66, 68, 70, and thus the capacity of its respective pump 78, 80, 82 to be adjusted based upon the desired ratios of the components being pumped by the respective pumps 78, 80, 82. To assist in making this adjustment, the pumping apparatus 24 includes a stroke length ratio gauge 150. The piston rod nuts 138, 139 and numbered scale 150 permit the operator to set the strokes of pistons 66, 68, 70 and thus the ratios of components. Operators of prior art systems typically are required to move the pump mounting points along a rocker plate. It is difficult in such systems to measure the prior art pumps' strokes very accurately. This requires many ratio checks during setup to measure the pumps' outputs and set the ratios as desired.

The positions of the various locknuts 138 in the illustrated embodiment produce ratios of the stroke lengths of pumps 78, 80, 82 of 2:1:2. It should be noted that these are not volume ratios. The volume ratios depend not only upon the ratios of the stroke lengths, but also upon the ratios of the diameters of the cylinders 72, 74, 76. In the illustrated embodiment, the cylinders 72, 76 have equal diameters and cylinder 74 has a diameter about 1.44 times the diameters of cylinders 72, 76. The threaded connecting rods 60, 62, 64 have holes 151 (only one of which can be seen because the others are obscured by locknuts 138) in them that accept pins to change to the full strokes of the rods quickly. This permits quick priming of the pumps 78, 80, 82. Prior art systems require more cycles before the fluid lines are primed. Also, when the system 24 is being flushed, full strokes facilitate flushing of unused components from the pumps 78, 80, 82.

The supply of air to, and exhausting of air from, air motors 40 is controlled by pneumatic limit switches 152, 154 which are mounted on the inside of side plate 114. Switches 152,154 illustratively are SMC Corporation part VM131-N01-01 valves. The limit switches 152, 154's actuators 156, 158, respectively, project into the path of the head of a cap screw 160 which projects from an end of push plate 54 toward side plate 114. As the pistons 46, 48 travel upward in their respective cylinders 42, 44 in response to compressed air supplied through limit switch 154 and compressed air fittings 162 through which compressed air is supplied to cylinders 42, 44 beneath pistons 46, 48, the components are pumped from cylinders 72, 74, 76. To render component flow from pumps 72, 74, 76 smoother and less pulsatile, an adjustable flow restrictor 163 or the like can be placed in the exhaust outlet, FIG. 7. Adjustable flow restrictor 163 illustratively is a DeVilbiss air adjusting valve, part HAV-500. As pistons 46, 48 reach the limits of their upward travel, actuator 156 engages cap screw 160. The supply of compressed air through fittings 162 is interrupted. Compressed air is then supplied through compressed air fittings 164 to cylinders 42, 44 above pistons 46, 48, and fresh quantities of components are drawn into cylinders 72, 74, 76. Push plate 54 travels downward until actuator 158 engages cap screw 160. The supply of compressed air through fittings 164 is then interrupted, the adjusted capacities of cylinders 72, 74, 76 having been reached. The supply of compressed air is then returned by limit switch 154 to compressed air fittings 162, and pumping of components from cylinders 72, 74, 76 through dispensing nozzles 165, FIG. 1, resumes. When the apparatus 24 is turned off, the supply of air to switch 154 is interrupted. Since there is no air to reverse the directions of pistons 46, 48 in their respective cylinders 42, 44, the pistons 46, 48 would tend to bottom out against bottom plate 104. The bumpers 119 stop pistons 46, 48 before the pistons 46, 48 bottom out.

Operators of prior art systems are cautioned to stop the prior art systems' pumps manually in such orientations that pump parts wetted by components being pumped remain wet. Permitting pump 78, 80, 82 parts to dry out would reduce their ability to maintain seals. The on/off switch 167, see FIG. 1, for the apparatus 20 is in the air line to the air cylinders' limit switch 154. Switch 167 illustratively is an SMC Corporation part NVM130-N01-08 valve. Pumps 78, 80, 82 thus do not stop at the exhaust (top) ends of their strokes. In this way, pump 78, 80, 82 parts wetted by the components being pumped remain wet.

Figure 8:
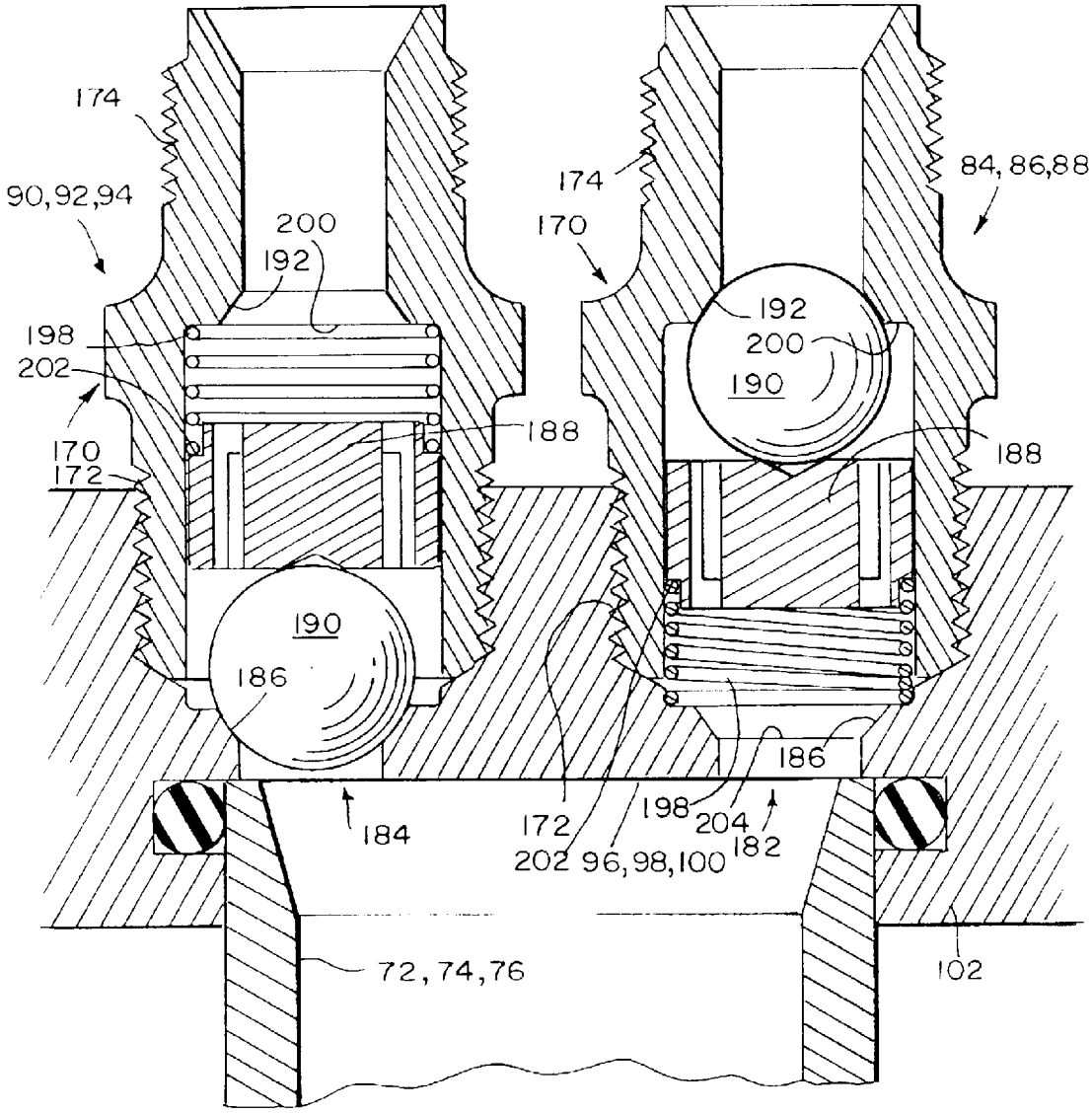

Turning now particularly to FIG. 8, each intake 84, 86, 88 and exhaust 90, 92, 94 valve includes a valve housing 170. The housing 170 is threaded at an end 172 to be received into a threaded opening at the appropriate location in top plate 102 in the head 96, 98, 100 of a respective cylinder 72, 74, 76. Each housing 170 is also threaded at its other end 174 to couple a hose 176 (FIG. 2*a*) coupler for coupling the pump 78, 80, 82 to a component source, for example, a pot 26, in the case of the intake valves 84, 86, 88, or to a hose 178 (FIG. 4) coupler for coupling the pump 78, 80, 82 to a dispensing nozzle 165 (FIG. 1), in the case of an exhaust valve 90, 92, 94.

Each intake 182 and exhaust 184 port is provided with a seat 186 for a valve ball 190. On the exhaust valves 90, 92, 94, seats 186 are used. On the intake valves 84, 86, 88, seats 186 are not used. Each valve 84, 86, 88, 90, 92, 94 further includes a valve insert 188 for capturing a valve ball 190, either against seat 186 or against a seat 192 provided within housing 170, depending upon whether the valve 84, 86, 88, 90, 92, 94 is an exhaust valve 90, 92, 94 or an intake valve 84, 86, 88, respectively. The inserts 188 urge the balls 190 into the valve 84-, 86-, 88-, 90-, 92-, 94-closing orientations, owing to coil valve springs 198 which are captured between a shoulder 200 provided in the housing 170 and a shoulder 202 provided on the insert 188, in the case of the exhaust valves 90, 92, 94, or between the shoulder 202 provided on the insert 188 and a shoulder 204 provided in the head 96, 98, 100 adjacent the port 182, 184, in the case of the intake valves 84, 86, 88. The placement of the check valves 84, 86, 88, 90, 92, 94 of the illustrated system externally permits easy access to the valves 84, 86, 88, 90, 92, 94 for maintenance. The valves of plural component systems are the components of such systems which typically require the most frequent maintenance. In typical prior art systems, inlet or outlet check valves, or both, are inside the pump. This, of course, requires disassembly of such prior art systems for maintenance on the check valves. Additionally, the flow directions in the check valves of the illustrated system are reversible. The flow directions in valves 84, 86, 88, 90, 92, 94 can be changed by changing the internal assembly of the valve parts. This also results in a reduction in parts count.

Referring back to FIGS. 6 and 7, compressed air is supplied to a fitting 220 to an adjustable inlet pressure regulator 222 which includes a gauge 223. Regulator 222 illustratively is a DeVilbiss model HARG-510 pressure regulator. The output port 224 of regulator 222 is coupled to an input port 226 of a double-acting valve 228. Valve 228 illustratively is a Rexroth model PS34010-3333 CD-7 valve. Regulated air is supplied to two output ports 230, 232 of valve 228. Output port 230 is coupled through (a) suitable conduit(s) (not shown), such as a compressed air hose, to fittings 162. Output port 232 is coupled through (a) suitable conduit(s) to fittings 164. Compressed air is also supplied from fitting 220 to an input port 234 of'switch 152. An output port 236 of switch 152 is coupled to an input port 238 of double-acting valve 228. Compressed air is also supplied from fitting 220 to an input port of switch 167. An output port of switch 167 is coupled to an input port 240 of switch 154. An output port 242 of switch 154 is coupled to an input port 246 of double-acting valve 228. Two exhaust ports 248 of double-acting valve 228 are coupled 249 together, and to an input port 250 of adjustable flow restrictor 163. An output port 252 of adjustable flow restrictor 163 is vented to atmosphere.

While the illustrated system is a 3K system, it can be used to dispense single component-materials or two-component materials. Additionally, it should be clear that systems according to the present invention can be built up to dispense plural component systems having more than three components. For a two component system, one pump section 78, 80, 82 would be left out of the assembly. For systems of more than three components, one more pump 78, 80, 82 section would be added for each additional component.

What is claimed is:

1. A pumping apparatus for pumping at least a component of a coating material, the pumping apparatus including a first piston, a first cylinder in which the first piston is reciprocable to draw the at least a component of a coating material to be pumped into the first cylinder during an intake stroke of the pumping apparatus and to exhaust the at least a component of a coating material from the first cylinder during an exhaust stroke of the pumping apparatus, the first cylinder including a support, at least two pumping motors, the first cylinder oriented between the pumping motors, the pumping motors being coupled to the support and to the first piston to move the support and first piston relatively toward each other during an exhaust stroke of the pumping apparatus and relatively away from each other during an intake stroke of the pumping apparatus.

2. The apparatus of claim 4 wherein the pumping motors each include a pumping motor piston and a pumping motor cylinder, the pumping motor pistons coupled to the first piston.

3. The apparatus of claim 2 wherein each pumping motor piston is coupled to a pumping motor connecting rod, the first piston is coupled to a first connecting rod, and the pumping motor connecting rods and first connecting rod are coupled together.

4. The apparatus of claim 3 wherein the pumping motor connecting rods and first connecting rod are coupled together by being coupled to coupling means.

5. The apparatus of claim 4 wherein the support includes means providing a first head for the first cylinder and a pumping motor head for each pumping motor.

6. The apparatus of claim 5 wherein the support further includes means providing an intake valve into the first cylinder and an exhaust valve from the first cylinder and a port for supplying a driving fluid to each pumping motor.

7. The apparatus of claim 1 wherein the support includes a first member at a first end of the first cylinder, a second member at a second end of the first cylinder, a base, and a side member supporting the second member from the base.

8. The apparatus of claim 7 wherein the pumping motors each include a pumping motor piston and a pumping motor cylinder including a cylinder head, the pumping motor pistons coupled to the first piston, and the base includes a stop for limiting movement of the pumping motor pistons away from their respective heads.

9. The apparatus of claim 7 further including means for guiding the pumping motor connecting rods, the pumping motor connecting rod guiding means being coupled to the second member.

10. The apparatus of claim 1 including a plurality of first pistons, an equal plurality of first cylinders in which respective first pistons are reciprocable to draw plural materials to be pumped into respective first cylinders during an intake stroke of the pumping apparatus and to exhaust the plural materials from respective first cylinders during an exhaust stroke of the pumping apparatus.

11. The apparatus of claim 1 wherein the first piston includes integral seal means.

12. The apparatus of claim 4 wherein the first connecting rod includes means for adjusting the stroke of the first connecting rod to adjust the output of the pumping apparatus.

13. The apparatus of claim 12 wherein the means for adjusting the stroke of the first connecting rod includes means selectively movable along the length of the first connecting rod, the coupling means engaging the means selectively movable along the length of the first connecting rod to move the first piston.

14. The apparatus of claim 13 further including a gauge to assist in adjusting the stroke of the first connecting rod.

15. The apparatus of claim 4 further including position indicating means provided on the coupling means, and pumping motor control means for sensing the position of the position indicating means.

16. The apparatus of claim 1 further including lubricating means provided on the first piston for lubricating the first cylinder.

17. The apparatus of claim 16 wherein the lubricating means includes a disk of a material impregnated with a lubricant.

* * * * *